US007637196B2

(12) United States Patent
Thornton

(10) Patent No.: US 7,637,196 B2
(45) Date of Patent: Dec. 29, 2009

(54) SYSTEM AND METHOD FOR DETECTING OBJECTS AND SUBSTANCES

(75) Inventor: Anthony L. Thornton, Fort Worth, TX (US)

(73) Assignee: Lockheed-Martin Corporation, Bethesda, MD (US)

( * ) Notice: Subject to any disclaimer, the term of this patent is extended or adjusted under 35 U.S.C. 154(b) by 241 days.

(21) Appl. No.: 11/059,755

(22) Filed: Feb. 16, 2005

(65) Prior Publication Data

US 2005/0188828 A1 Sep. 1, 2005

Related U.S. Application Data

(63) Continuation-in-part of application No. 10/463,137, filed on Jun. 16, 2003, now abandoned.

(51) Int. Cl.
*F41H 11/12* (2006.01)

(52) U.S. Cl. ..... 89/1.13; 102/402; 342/22; 342/29

(58) Field of Classification Search ..... 89/1.11, 89/1.13; 86/50; 102/402; 342/22, 29
See application file for complete search history.

(56) References Cited

U.S. PATENT DOCUMENTS 4,553,718 A * 11/1985 Pinson ..... 244/3.15
6,567,044 B2 * 5/2003 Carroll ..... 342/465
2002/0062730 A1 * 5/2002 Thornton ..... 86/50
2002/0092949 A1 * 7/2002 Nicolai ..... 244/106

OTHER PUBLICATIONS

"JFK Chat Transcripts", John Perry Fish (cnn.com), Jul. 21, 1999.*
FAS Military Analysis Network: AN/ALR-69 Radar Warning Receiver, Apr. 18, 2000.*
FAS Military Analysis Network: F-16 Fighting Falcon, May 1, 1999.*
FAS Military Analysis Network: F-15 Eagle, Jun. 10, 2000.*
Army Technology—Predator—Unmannmed Aerial Vehicle, USA, Sep. 13, 2001.*
FAS Intelligence Resource Program: RQ-1 Predator MAE UAV, May 6, 2000.*
http://www.usatoday.com/news/world/iraq/_common/_images/predator/flash.htm (date unkown).*
FAS Military Analysis Network: UH-60 Black Hawk, Apr. 23, 2000.*
FAS Military Analysis Network: H-3 Sea King, Dec. 24, 1998.*
FAS Military Analysis Network: CH-46E Sea Knight, Dec. 24, 1998.*

(Continued)

*Primary Examiner*—Troy Chambers

(57) ABSTRACT

A system for detecting and identifying the presence of objects, substances, or other items of interest located above or beneath a surface includes at least one aerial platform capable of powered flight, and a base station including apparatus for launching, storing, and refueling the at least one aerial platform. The base station further includes apparatus for communicating with the aerial platform(s). A control station remote from the base station can be configured to communicating with the base station. A display can be associated with the base station and the control station to receive signals from the aerial platform and indicate the location and identity of the objects, substances, or other items detected by the aerial platforms.

14 Claims, 3 Drawing Sheets

OTHER PUBLICATIONS http://www.uscg.mil/d14/news_release/2000/Nov2000.htm, Nov. 2, 2000.*
http://www.afrc.af.mil/507arw/NR-5.htm, Jan. 31, 2000.*
http://www.510fs.org./CodeOne/c1s8to.htm, 3rd quarter 2001.*
http://www.uscg.mil/d14/news_release/2001/Feb2001.htm, Feb. 28, 2001.*
FAS Military Network: Air Anti-Submarine Warfare, Mar. 14, 1999.*
http://www.battlebelow.com/destroyer.htm (Destroyer Tactics, Nov. 16, 2001.*
FAS Military Analysis Network: AH-64 Apache, retrieved Sep. 12, 2006.*

* cited by examiner

SYSTEM AND METHOD FOR DETECTING OBJECTS AND SUBSTANCES

CROSS-REFERENCE TO RELATED APPLICATION

This application is a continuation-in-part of U.S. patent application Ser. No. 09/725,770 entitled "Apparatus For Detecting, Identifying, And Validating The Existence Of Buried Objects."

BACKGROUND

Apparatus for detecting and identifying the existence of buried or submerged objects are known in the prior art. For example, U.S. Pat. No. 4,641,566 to Pomeroy discloses a process for locating buried plastic mines or nonmetallic objects which involves spraying a suspected area with a leach of ionized metal and leaching the ionized metal into the soil to leave a metallic concentrate on an impervious object, such as a plastic mine. An array of detectors detects anomalies of concentrations of the metal, the concentrations being the result of the leach settling on or about the impervious object.

U.S. Pat. No. 5,452,639 to Aulenbacher et al. discloses ground-scanning sensors mounted on a light-weight, unmanned, remote-controlled vehicle which travels over areas contaminated with buried ammunition to automatically locate and map the area without endangering the searching crew. The controlled vehicle is controlled from, and the sensor signals are evaluated in, a second vehicle which is generally disposed in the immediate vicinity of the area being examined.

U.S. Pat. No. 5,869,967 to Strauss discloses a device for the detection of objects lying in the earth which, irrespective of topography, soil structure, and state of the terrain, permits high surface yields with great precision in identifying the position of the objects to be detected without endangering the operating personnel. In particular, the device comprises at least one jib mounted on a mobile device which is swivellable about a vertical axis on whose free end are arranged adjacent to one another several measuring heads for sweeping over strip-shaped surface areas of the terrain to be investigated. With the measuring heads on the free end of the jib, at least one ground marking device is arranged for distinguishing the find site determined by the measuring heads. The ground marking device includes a paint spraying device as well as a stake marking device next to aerial measuring head.

Problems associated with these prior systems include their inability to hover at a predetermined height without being anchored or tethered. While submarines are capable of fixed depth operations, such vehicles use pumps or vertical thrusters to achieve buoyancy. Some known devices, which use gas filled flexible chambers to control buoyancy and therefore the depth of vehicle operation, are prohibitively expensive due to the supply of gas which must be carried in the vehicle for correction of depth errors over a sustained period of vehicle operation.

SUMMARY

A system and method for detecting, identifying, and confirming the existence of buried objects, such as ground ordinance, and other substances, capable of overcoming many of the disadvantages and drawbacks of similar systems known in the art is provided.

In one embodiment, a method for detecting objects in a region comprises establishing a communication link between a base station and at least one aerial platform, wherein the aerial platform includes a detection sensor. The aerial platform is assigned to inspect a defined sub-region. The sub-region overlaps a portion of other sub-regions to be inspected in the region. The location of objects detected by at least one of the aerial platforms is communicated to the base station.

In another embodiment, a system for detecting buried objects comprises a plurality of aerial platforms. A base station is configured to communicate with the plurality of aerial platforms. At least one aerial platform is configured to autonomously fly over a region to be examined, detect the presence of a buried object, identify the buried object, and transmit a signal indicating the location and identity of the detected buried object.

Other objects, advantages and features of embodiments of the invention will become more apparent, as will equivalent structures which are intended to be covered herein, with the taerialing of the principles of the disclosure.

DETAILED DESCRIPTION OF THE FIGURES

The following description is provided to enable any person skilled in the art to make and use embodiments of the invention and sets forth the best modes contemplated by the inventor of carrying out embodiments of his invention. Various modifications, however, will remain readily apparent to those skilled in the art, since the generic principles of embodiments of the present invention have been defined herein specifically to provide a system for detecting, identifying and verifying buried or submerged ordinance that encompasses many long sought after features that make such functions easier and less expensive to perform, with more comprehensive results.

Figure 1:
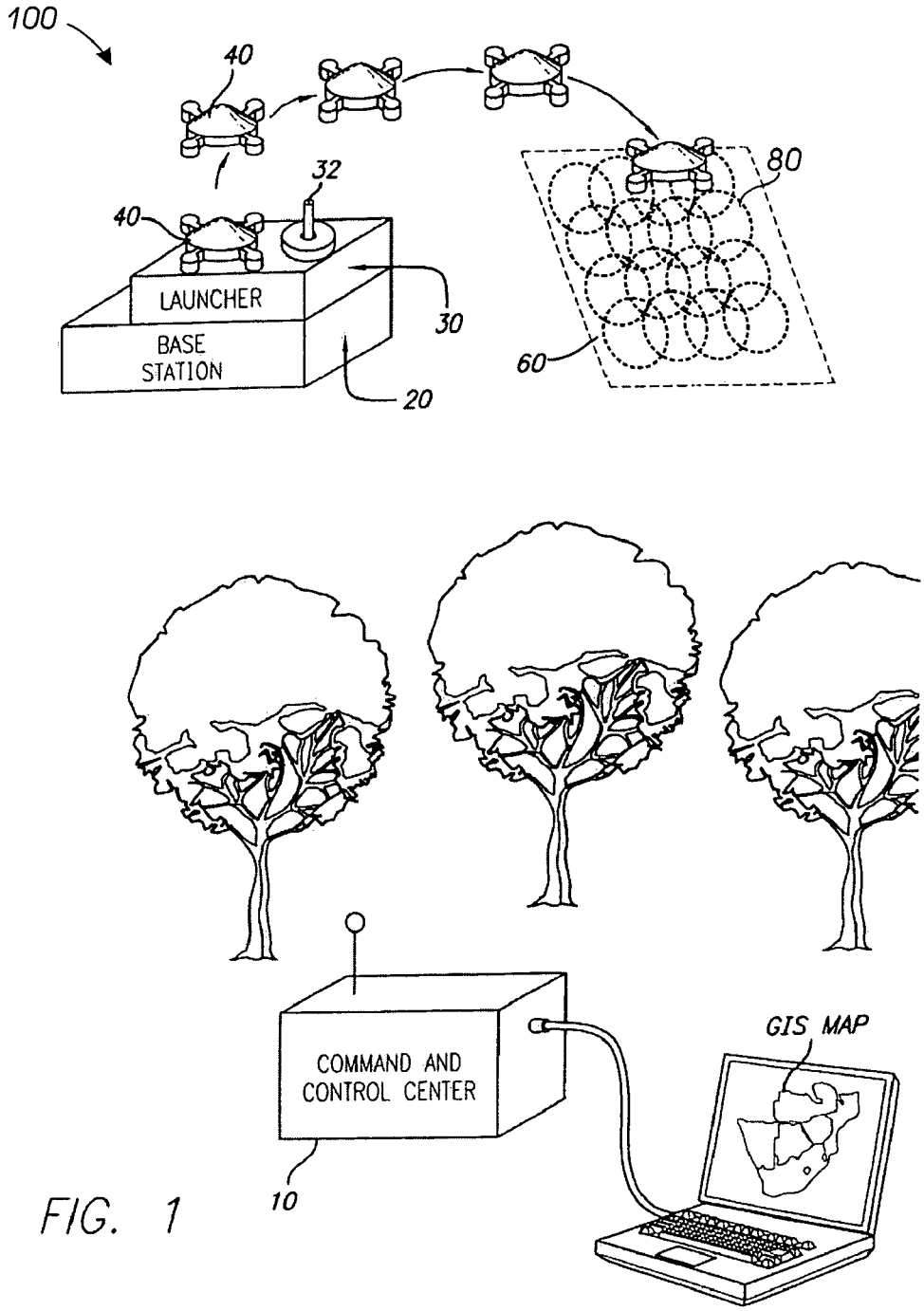
FIG. 1 is a schematic diagram depicting components included in an embodiment of a system for detecting buried objects.

Referring to FIG. 1, an embodiment of a system 100 for detecting objects includes a control center 10. In the depiction of FIG. 1, control center 10 is shown located at a remote location from base station 20. In other embodiments, base station 20 and control center 10 can be co-located. Base station 20 includes a launcher apparatus 30 for launching one or more of a plurality of aerial platforms 40. After launch, aerial platform 40 propels and guides itself to a sub-region 80 of area 60 that has been identified at the control center 10 as the location to be searched by a particular aerial platform 40 for substances such as buried ordinance.

Figure 2:
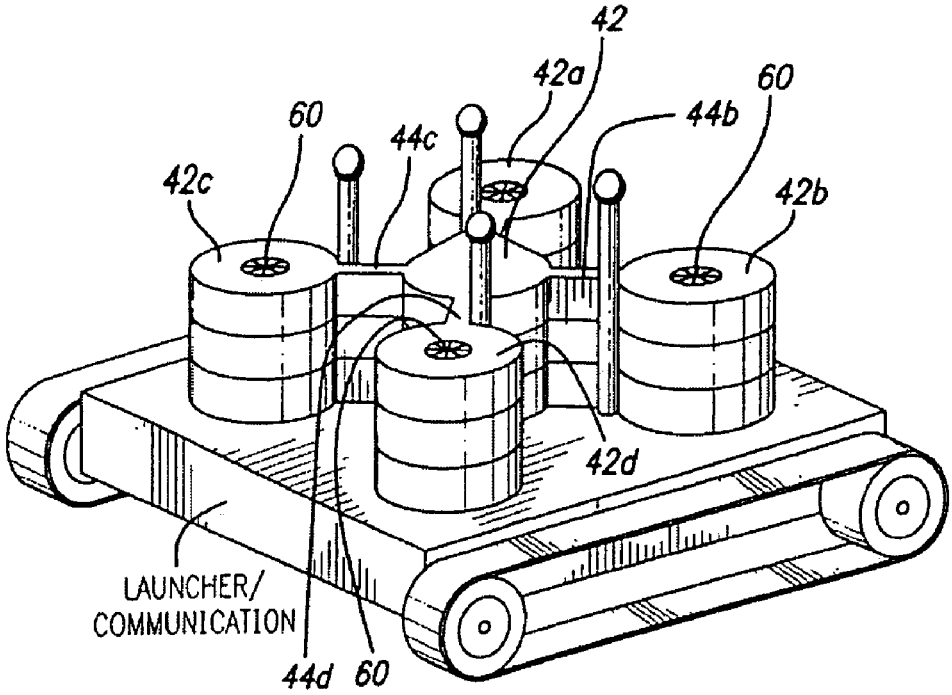
FIG. 2 depicts an embodiment of an aerial platform that can be utilized with the system of FIG. 1.
Figure 3:
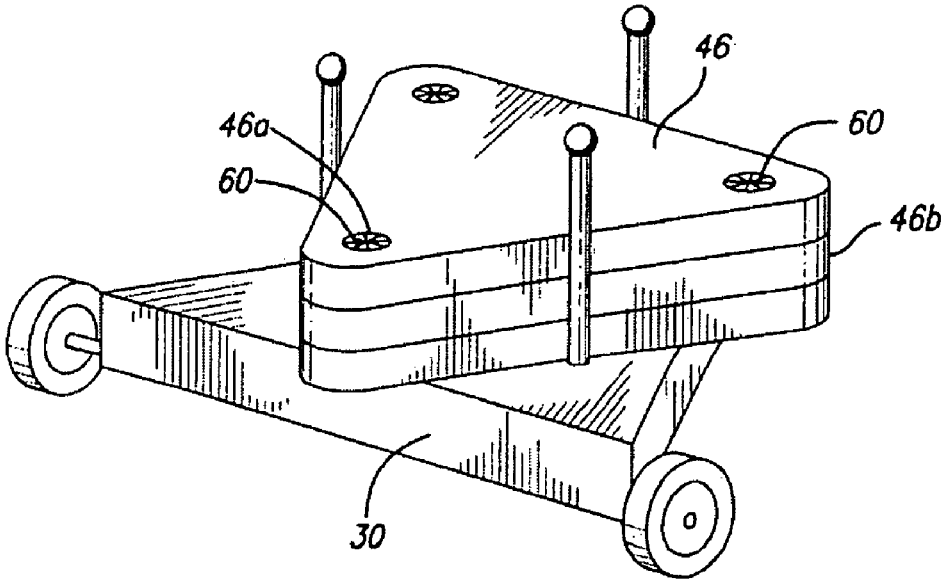
FIG. 3 depicts another embodiment of an aerial platform that can be utilized with the system of FIG. 1.

Two examples of configurations of aerial platforms 40 are shown in FIGS. 2 and 3. The configuration shown in FIG. 2 is an "X-wing" sentry craft having a substantially elliptical body portion 42 about which are located four lobes 42*a*, 42*b*, 42*c*, 42*d*. In some embodiments, lobes 42*a-d* can be approximately equally spaced about the periphery of body portion 42. Lobes 42*a-d* can also be separated from body portion 42 by support arms 44*a*, 44*b*, 44*c*, 44*d*. The configuration shown in FIG. 3 is a "Delta-Wing" sentry craft having a substantially deltoid shaped body portion 46 bearing two lobes 46*a*, 46*b* spaced apart from one another at the ends of the base of the triangular or deltoid-shaped body portion 46. Other suitable shapes for body portions 42, 46 and lobes 42*a-d*, 44*a-d* can be utilized.

Figure 4:
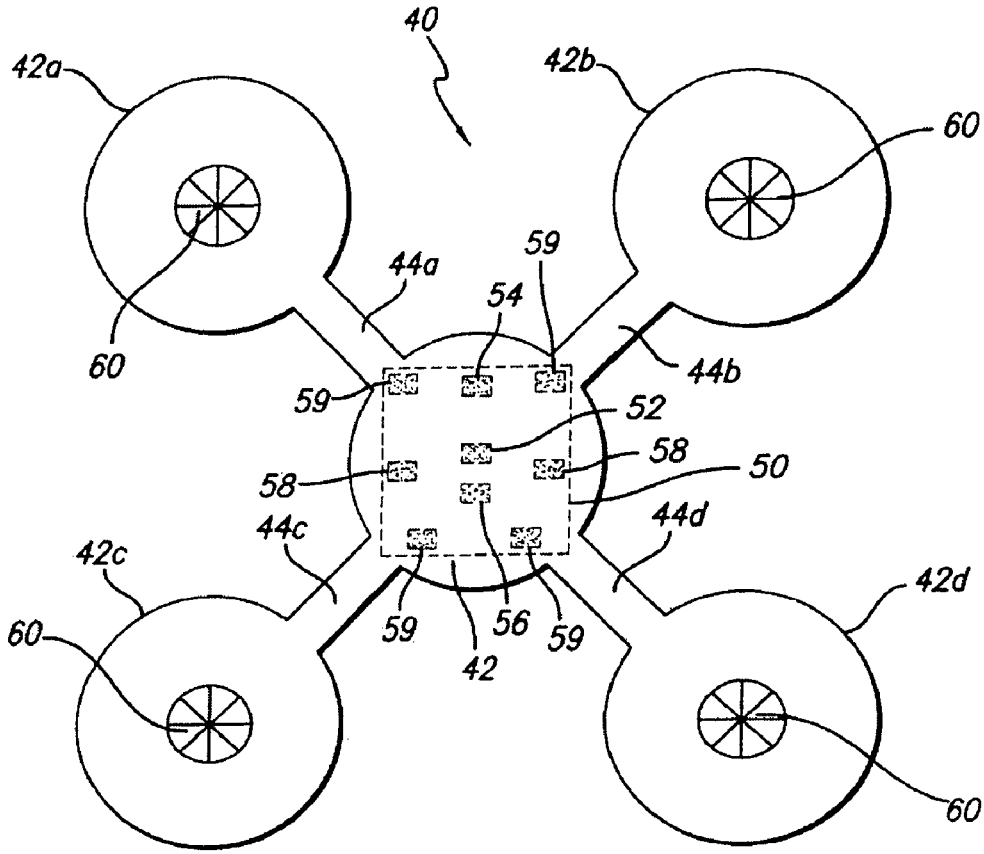
FIG. 4 depicts an embodiment of a sensor as deployed on the aerial platform of FIG. 2.

The embodiment of aerial platforms 40 shown in FIGS. 1 and 4 include a suitable propulsion system, such as gimbaled lift fans 60 in aerial lobe. Other suitable propulsion systems can be utilized. The outer skin of platforms 40 can be comprised of a lightweight durable plastic shell, or other suitable material. The central interior portion of platform 40 can contain a suitable propulsive source, such as an engine (not shown) with appropriate motor and drive shaft, and suitable navigation and control components 50, which are shown in FIG. 4 to include navigation sensor 52, flight control system 54, communication system 56, proximity and collision avoidance sensors 58, and one or more suitable types of sensors 59 for detecting various types and sizes of detectable objects and/or substances, such as chemicals, gases, radioactive substances, and metallic objects. Examples of different types of sensors 59 that can be utilized included RADAR, FLIR, electromagnetic, ultrasound, and lasers. Sensors 59 can be capable of detecting objects and/or substances above and/or below a surface, and more than one type of sensor 59 can be utilized on aerial platform 40.

Aerial platform 40 can be programmed to inspect one or more sub-regions 80 (FIG. 1) and then return to the base station 20. Aerial platforms 40 can be configured to hover above a point within any suitable range of height, such as, for example, from 0.5 to 10 feet above the ground level altitude. Maximum speed of aerial platforms 40 can be within any suitable range, such as 10 to 20 miles per hour, for example.

Base station 20 (FIG. 1) can include launcher assembly 30, which can also serve as a storage, docking, launch, and refueling station. Base station 20 can also house a communication link to aerial platforms 40 and a display device (not shown) for monitoring the location of the aerial platforms and the location of objects detected by the aerial platforms 40. A number of aerial platforms 40 can be stored on one base station 20 so that a single base station 20 can cover a predetermined amount of area within a given time. For example, a base station 20 that can store ten platforms 40 capable of autonomously inspecting over one-tenth of a square mile can inspect a total area 60 of a square mile. Further, aerial platforms 40 can be programmed to autonomously inspect more than sub-region 80. Still larger areas 60 can be inspected with additional base stations 20, or by providing more platforms 40 with base station 20, depending on the range of aerial platform 40.

In some embodiments, base station 20 can perform the following functions:

a) provide compact storage and transport of the aerial platforms 40;

b) serve as a home base launch point from which to release the aerial platforms 40;

c) serve as a refueling station for returning platforms 40; and d) serve as a centralized, portable, communication link between platforms 40 and control center 10.

Control center 10 can be configured to permit a human operator to use a display system, such as a Geographic Information System (GIS) information on a personal computer (PC), to map out area 60 to be inspected. Various subsystems contained in control center 10 can automatically decompose or divide area 60 into overlapping sub-regions 80, and assign the sub-regions 80 to one or more aerial platforms 40. Aerial platforms 40 can also be assigned to inspect more than one sub-region 80. Aerial platforms 40 can navigate or otherwise be sent, to a starting position, such as the centroid of sub-region 80. Platform 40 can autonomously search for ordinance or other detectable objects or substances within sub-region 80 using a suitable search pattern that covers all or substantially all of sub-region 80. As used herein, the term "autonomously" refers to aerial platforms performing various functions under the direction of navigation and control components 50 and/or other suitable automated controller(s).

While in search mode, any platform 40 detecting an object or other substance of interest can hover over the object and autonomously send a signal indicating the location of the detected object to base station 20. For example, platform 40 can send its current GPS coordinate location that can appear on the GIS map as a colored dot. At that point, platform 40 can be configured to hover as close as possible to the object and turn on additional sensors (electromagnetic, metal, chemical, video, etc.) to identify the type of object or substance detected. Navigation and control components 50 can include logic to help identify the detected object or substance autonomously. If platform 40 identifies the object or substance, platform 40 can automatically send a signal to display a different symbol, such as a differently colored dot or line of text, to indicate the type of object or substance detected on a display at base station 20 and/or control station 10.

Once an object or substance is identified, platform 40 can continue the search pattern until the assigned sub-region(s) 80 have been inspected. When platform 40 completes the search of the assigned sub-region(s) 80, aerial platform 40 can return to base station 20 for refueling, or begin searching another sub-region 80.

Those skilled in the art will appreciate that various adoptions and modifications of embodiments disclosed herein can be configured without departing from the scope and spirit of embodiments of the invention. For example, the terms "objects" and "substances" and "items" can be used interchangeably. Therefore, it is to be understood that, within the scope of the appended claims, embodiments of the invention may be practiced other than as specifically described herein.

What I claim is:

1. A detection system, comprising:

a plurality of aerial platforms;

automated controllers included in the aerial platforms;

a base station configured to communicate with the aerial platforms, the aerial platforms are configured to autonomously perform the following functions under the direction of the automated controller:

fly over a region to be examined, the region to be examined is divide into overlapping sub-regions, and the sub-regions are assigned among the aerial platforms;

inspect the sub-regions;

detect the presence of a buried object;

identify the buried object;

transmit a signal indicating the location and identity of the detected buried object to the base station.

2. The system of claim 1, further comprising the aerial platforms are further operable to autonomously hover over the detected object under the direction of the automated controller included in the aerial platforms.

3. The system of claim 1, further comprising:

a display system configured to receive the signal indicating the location and identity of the buried object and to display a symbol based on the signal.

4. The system of claim 1, further comprising the aerial platforms are operable to autonomously perform the following functions under the direction of the automated controller included in the aerial platforms:

navigate to a predetermined location in the region to be examined; and determine and execute a search pattern to inspect the region.

5. The system of claim 1, further comprising the base station is further configured to store and launch the aerial platforms.

6. The system of claim 1, further comprising the base station is further configured to automatically transmit the signals from the aerial platforms to a control center.

7. The system of claim 1, further comprising the aerial platforms include an aerial collision avoidance sensor.

8. A system for detecting objects in a region, comprising:

a plurality of aerial platforms, the aerial platforms include an automated controller, a detection sensor, and an aerial collision avoidance sensor;

a base station configured to communicate with the aerial platforms and including:

a launcher assembly for the aerial platforms; and an automated subsystem operable to:

define partially overlapping sub-regions to be inspected by the aerial platforms;

determine a search pattern for inspecting the sub-regions and assign each of the sub-regions to at least one of the aerial platforms.

9. The system of claim 8, further comprising:

an automated controller operable to:

hover the at least one aerial platform over the location of an object detected by the sensor; and identify the object.

10. The system of claim 8, further comprising:

an automated controller operable to:

determine the type of a detected object; and transmit a signal representative of the type of the detected object to the base station.

11. The system of claim 8, further comprising:

an automated controller operable to:

transmit information regarding the aerial platforms and detected objects from the base station to a control center.

12. The system of claim 8, further comprising:

an automated controller operable to:

position the aerial platform at a predetermined location in the region to be examined; and fly the aerial platform over the region to be examined in the search pattern.

13. The system of claim 8, further comprising:

means for establishing a communication link between a base station and at least one aerial platform, wherein the at least one aerial platform includes a detection sensor capable of detecting a substance under a surface;

automated means for determining the location of the substance detected by at least one of the aerial platforms;

automated means for identifying the substance detected by the at least one aerial platform; and automated means for communicating the identity and location of the substance to the base station.

14. The apparatus of claim 8, further comprising:

means for hovering the at least one aerial platform over the location of the detected object or substance.

* * * * *